US005325745A

United States Patent [19]

Koehler

[11] Patent Number: 5,325,745

[45] Date of Patent: Jul. 5, 1994

[54] SCREWDRIVER

[76] Inventor: Albert Koehler, 2615 Murray Street, Port Moody, British Columbia, V3H 1X1, Canada

[21] Appl. No.: 92,852

[22] Filed: Jul. 19, 1993

[51] Int. Cl.[5] ..... B25G 1/08; B25B 23/00

[52] U.S. Cl. ..... 81/439

[58] Field of Search ..... 81/437–440, 81/177.4, 490

[56] References Cited

U.S. PATENT DOCUMENTS

| | | | |
|---|---|---|---|
| 1,497,363 | 6/1924 | Döppel . | |
| 1,705,205 | 3/1929 | Reams . | |
| 3,750,729 | 8/1973 | Lemieux . | |
| 3,753,455 | 8/1973 | Butler | 81/439 |
| 4,372,362 | 2/1983 | Ahn . | |
| 4,762,036 | 8/1988 | Orlitzky et al. . | |
| 5,195,761 | 3/1993 | Eimer | 81/439 X |

*Primary Examiner*—D. S. Meislin

[57] ABSTRACT

A screwdriver having a plurality of bits. There is housing having a hollow interior to receive the bits. The housing has a handle and an open end, remote from the handle. There is an internal column that is attached to the housing. The internal column has a recessed end to receive a bit and prevents rotation of the bit relative to the housing. There are openings around the housing extending longitudinally of the housing. Each bit is operated by an actuator extending through an opening in the housing. There is a leaf spring attached to the inner end of the actuator that receives a bit. The bit may be moved from a position of storage within the handle by pressing a pre-selected actuator, moving the bit attachment out of the open end of the housing, holding the actuator down and retracting the bit to engage the recess of the column. The guidance system is simpler than the prior art. The handle is smaller than the prior art systems. The mode of operation is simple.

10 Claims, 2 Drawing Sheets

34
70
36
38
40
46
60
58
12

SCREWDRIVER

FIELD OF THE INVENTION

This invention relations to a screwdriver.

DESCRIPTION OF THE PRIOR ART

A screwdriver is probably essential to every craftsman and artisan. Conventional screwdrivers simply comprise a handle with a single blade attached to it. Thus a complete set of screwdrivers can be quite bulky. In addition to different sizes of blade there are different types of blades, all of which should be present in any worthwhile tool-kit.

There have been efforts to reduce the volume required to store screwdrivers. The main approach has been the use of the handle of the screwdriver to store blades in the form of bits. The most common prior arrangement is that the bits are stored in a handle having a removable top. The screwdriver is fitted with a chuck. When it is desired to change a bit, the screw top is removed, the appropriate bit selected, the top put back in place and the bit put in the chuck. The chuck is then closed in conventional manner to locate the bit.

This prior art has received good acceptance, but it is believed that it can be improved. Existing screwdrivers of this type can be inconvenient in that selecting a bit involves turning the screwdriver upside down so that all the bits protrude from the handle that receives them. In these circumstances, bits can fall on the floor. The bits can also rattle in the handle, which can be an irritation.

There have been efforts to improve the prior art, principally directed at simplifying the selection process. For example, Ahn in U.S. Pat. No. 4,372,362 teaches a tool with a plurality of bits within a housing. The structure in Ahn requires a plurality of shafts extending through each bit with springs on each shaft to urge each bit outwardly. The bit is selected by pushing on an associated shaft and moving the shaft downwardly. Ahn has a chuck to grip the bits.

My own U.S. Pat. No. 4,762,036 issued Aug. 9, 1988 teaches a multi-bit screwdriver having a main body forming a handle with a cylindrical shaped outer end and a tapered inner end to receive a cone shaped bit retaining head having bit storage locations positioned around the head. A bit is received in each storage location. Each bit has a useable tip at one end and a locking head at the opposite end, typically provided with a ball/socket arrangement. There is a stop ring between the locking head and the useable tip. The usable tip of the bit extends through a tubular projection of the retaining head. There is a spring-loaded thrust washer in the head for retaining the bit in a locking receptacle and to prevent its rotation when the stop ring of the bit rests against the thrust ring. Actuating means for the screwdriver comprises a lever connected to the bit by a leaf spring near the locking head of the bit. The lever and the leaf spring are adapted for movement along channels in the retaining head. There are aligning means on the actuating means which aligns the locking head of the bit with the locking receptacle to allow the head to be retained in the receptacle.

SUMMARY OF THE INVENTION

The present invention seeks to simplify the prior art by reducing the number of components required while retaining the virtues of compactness, ease of selection and relative absence of rattle of the bits in storage.

Accordingly, the present invention provides a screwdriver having a plurality of bits and comprising a housing having a hollow interior to receive the bits, the housing having a handle and an open end, remote from the handle; an internal column, attached to the housing and having a recessed end to receive a bit and to prevent rotation of the bit relative to the housing; a plurality of openings around the housing and extending longitudinally of the housing; operating means for each bit, each means comprising an actuator extending through an opening in the housing and a leaf spring attached to an inner end of the actuator and adapted to receive a bit; whereby a bit may be moved from a position of storage within the handle by pressing a pre-selected actuator, moving the bit attached to the actuator out of the open end of the housing and retracting the bit to engage the recess of the internal column.

DESCRIPTION OF THE DRAWINGS

The invention is illustrated, by way of example, in the drawings in which.

DESCRIPTION OF THE PREFERRED EMBODIMENTS

Figure 3:
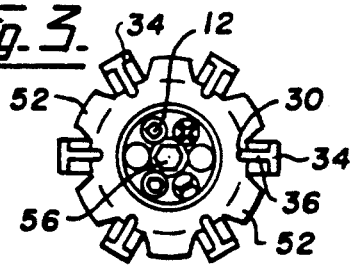
FIG. 3 is an end view of FIG. 1.

The drawings show a screwdriver 10 having a plurality of bits 12—see FIG. 3. The screwdriver 10 has a housing with a hollow interior to receive the bits 12 which are arranged around the periphery of the interior, as shown most clearly in FIG. 3. The housing comprises a handle 18, which is formed with recesses 20 to facilitate grip, and a front portion 22 with an open end 24, remote from the handle 18.

Figure 2:
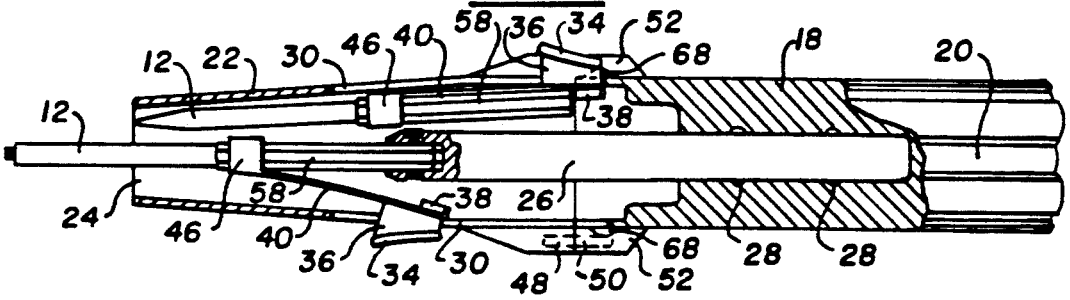
FIG. 2 is a sectional view of the screwdriver of FIG. 1.

There is a column 26 attached to the interior of handle 18. As shown in FIG. 2 the column 26 is formed with projections 28 which facilitate the holding of the column 26, usually of metal, in the handle 18, which is usually of plastic. There is a plurality of openings 30 around the housing, extending longitudinally.

The screwdriver includes operating means for each bit 12. The means comprises an actuator 32 having an external thumb piece 34 and a bridge 36 to extend through an opening 30. There is a projection 38 at the inner end of the actuator 32.

Figure 1:
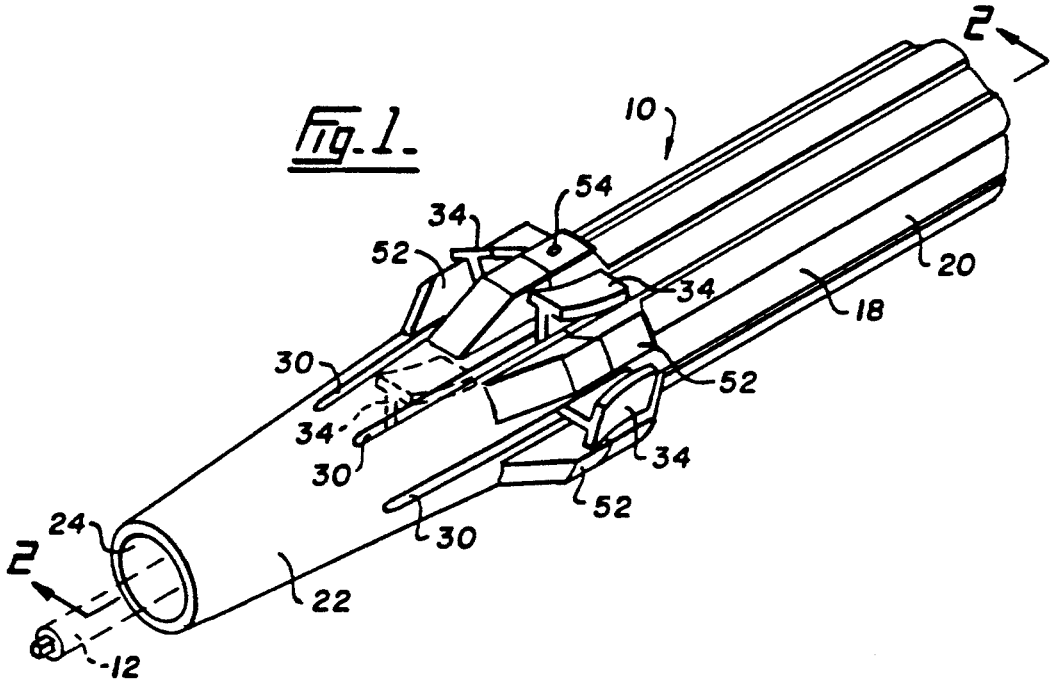
FIG. 1 is a perspective view of a screwdriver according to the present invention.
Figure 4:
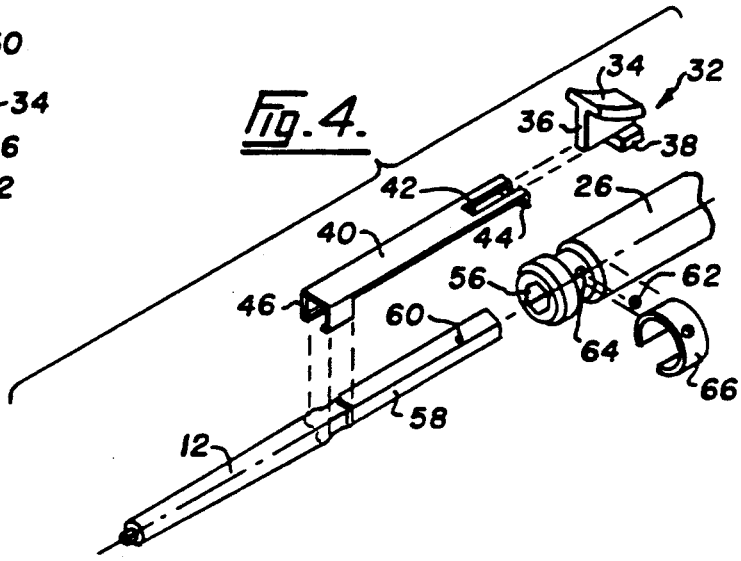
FIG. 4 is a detail of the operating means.

As shown in FIGS. 2 and 4 there is a leaf spring 40 joined to the thumb piece 34 by the provision of a bifurcated end 42 that engages the bridge portion 36 and has tabs 44 that engage the projection 38. At the distal end the leaf spring 40 is formed with a housing 46 that receives and grips a bit 12. Clearly, and as shown in FIGS. 1 and 2, any type of bit may be used. The driving end of the screwdriver bit 12, be it Philips, slot or any other available, is immaterial to the invention.

The handle 18 and the front portion 22 are formed with openings 48—see FIG. 2. Pins 50 extend between the openings 48 to hold the structure together. The openings 48 are conveniently formed in projections 52 moulded in the housing 14. To retain the two parts 18 and 22 together, a small set screw (not show) can be inserted through a threaded opening 54 shown in FIG.

1 to contact a pin 50 to prevent the housing 14 being separated inadvertently. In the embodiment of FIG. 1, the pins are attached to the front portion 22 and are a sliding but tight fit in the handle 18.

FIGS. 3 and 4 show a hexagonal recess 56 in the column 26. Each bit 12 has a corresponding hexagonal end 58 that is received with a reasonably tight fit in the recess 56. The tightness of the fit is improved by the provision of a dimple 60 in each hexagonal end 58 of the bit 12. The dimple 60 is engaged by a ball 62 projecting through an opening 64 in the column 26 and urged inwardly by a circular leaf spring 66, as shown in FIG. 4.

As shown in FIG. 2, there is a small projection 68 generally adjacent the rear edge of each opening 30 to contact the actuator 32 when it is in its retracted position. This provides a frictional, temporary location of the actuator 32 in the retracted position and acts to retain the bits 12 in storage.

To use the screwdriver according to the present invention, starting from the position with all the bits 12 retracted into the interior of the screwdriver, the thumb piece 34 on a preselected bit 12 is pushed downwardly and the bridge 36 then urged along an opening 30. The bit 12 emerges from end 24, as shown in FIGS. 1 and 2. When the bridge 36 abuts the leading end of the opening 30, the bridge 36 has to be pressed downwardly to overcome the tension of the leaf spring 40 and to line up the bit 12 with column 26. The hexagonal portion 58 of the bit 12 is just ahead of the hexagonal recess 56 in the column 26. The thumb piece 34 is then moved back towards handle 18 to ensure that the hexagonal end 58 of the bit 12 is engaged in the recess 56, with the dimple 60 engaged by the ball 62. The screwdriver may then be used.

To change the bit the thumb piece 34 is moved forward from the position shown in FIG. 2 until the bridge 36 contacts the leading edge of the opening 30. The thumb piece 34 is released and the bit 12 is thus moved out of alignment with the central column 26 due to the action of leaf spring 40. The bit 12 may then be retracted by moving the thumb piece 34 backwardly to the position shown in FIG. 1 in solid lines. When so retracted it engages a small projection 68 by sliding over projection 68. The actuator is thus retained by friction.

Figure 5:
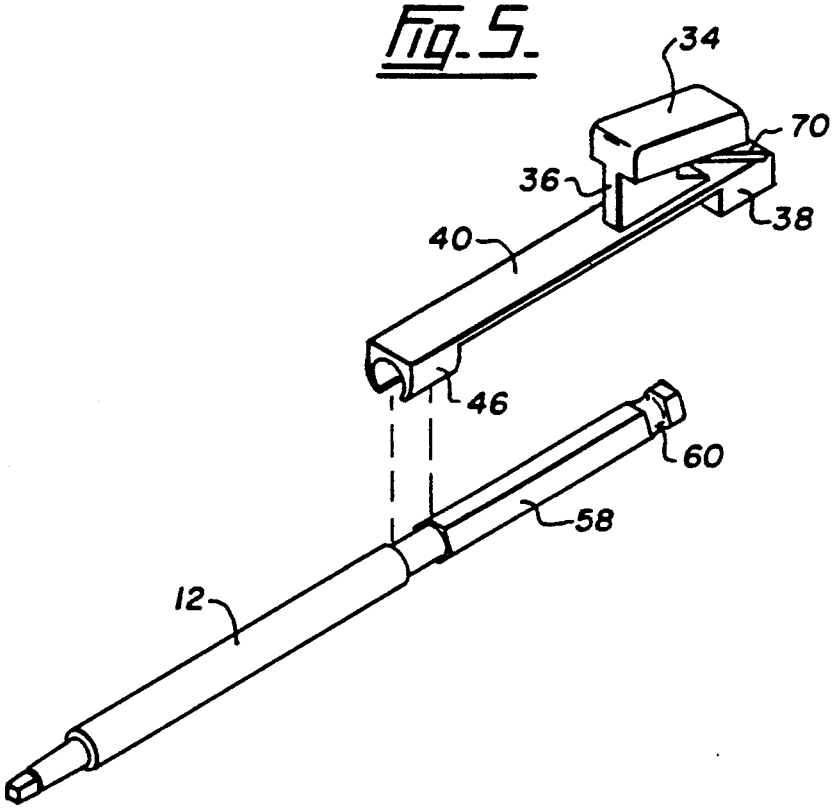
FIG. 5 is a variation of the embodiment of FIG. 4.

FIG. 5 is a view similar to FIG. 4 but illustrates a modification of the apparatus as shown in FIG. 4. The same reference numerals are used, as appropriate. The leaf spring 40 is of a plastic and is formed integrally with the housing 46 and the thumb piece 34.

The main improvement in FIG. 5 is the provision of a small leaf spring 70 adjacent to, and formed integrally with, thumb piece 34. The effect of this leaf spring 70 is to facilitate the withdrawal of the bit 12 and, in particular, the moving of the bit 12 out of alignment with the central column 36. With the embodiment shown in FIG. 4, a certain slight dexterity may be required. That is the thumb piece 34 may have to be manipulated to ensure that the hexagonal portion 58 of the bit 12 is not in alignment with the central column 26 when it is required to move the bit 12 back into the storage position. The additional, integral leaf spring 70 is a means of ensuring this. It acts on the exterior of the housing to provide a more positive location of the thumb piece 34 and to ensure that the thumb piece 34 moves upwardly, that is in a direction away from the central column 26, when the thumb piece is released. In this way no dexterity is required to return the bit 12 to its storage position. It is simply necessary to move the thumb piece 34 forward from the position shown in FIG. 2 until the bridge 36 contacts the leading edge of the opening 30 as in the embodiment of FIG. 4. At that stage the thumb piece is released, again as with the embodiment of FIG. 4, but the additional leaf spring 70 ensures positive movement of the thumb piece upwardly and, with it, the bit 12.

Desirably, a marking should be made on the exterior of the housing 14 to show what type of screwdriver bit or blade is associated with each thumb piece 34.

The screwdriver is commendably rattle free. However, to improve this virtue further, channels may be provided in the housing, adjacent each bit 12 and between the openings 30, so that bits do not contact each other but only the walls of the channel. The channels are omitted from the drawings to enhance clarity.

In the main the screwdriver of the present invention may be moulded from plastic. It is, however, preferred to have most of the components shown in FIG. 4 of metal. In particular, the bit will almost invariable be of metal as will the column 26 and the spring 40.

The illustrated embodiments are mere examples of the present invention. Variations may be made. For example, FIGS. 4 and 5 show the use of dimples 60 to receive a spring loaded ball 62 to ensure positive location in the column 26. However, the column 26 may be provided with a small, internal magnet to provide magnetic location of the bit 12. In those circumstances the dimple 60 would not be necessary and, indeed, its elimination would be desirable to ensure the maximum magnetic contact.

Similarly, FIG. 2 shows the column 26 attached to the interior of handle 18 and use of projections 28 to facilitate the holding of the column 26. However the column 26 may be polygonal, for example hexagonal, and the interior of the handle 18 may be formed with a correspondingly shaped polygonal channel. That is the dimples 28 would not be present. In these circumstances, the column 26 could simply be a press fit within the channel of the handle 18 or column 26 could be pressed into the handle 18 while the handle, which is usually of plastic, is still warm. By this means the column 26 is permanently located in the handle 18 and, of course, cannot rotate relative to the handle 18.

Although the mode of operation is similar to the mode of operation of the screwdriver I have described and claimed in my U.S. Pat. No. 4,762,036, discussed above, the screwdriver of the present invention allows for parallel bit storage instead of storage at an angle and reduces the handle diameter as a result. There is no special bit guidance at the front end of the screwdriver according to the present invention, unlike my prior patent. The stored bits in the present invention provide enough support for a bit which is being inserted.

I claim:

1. A screwdriver having a plurality of bits and comprising:

a housing have a hollow interior to receive the bits, the housing having a handle and an open end, remote from the handle;

an internal column, attached to the housing and having a recessed end to receive a bit and to prevent rotation of the bit relative to the housing;

a plurality of openings around the housing and extending longitudinally of the housing;

operating means for each bit, each operating means comprising an actuator having an external thumb piece, a narrowed bridge section passing through an opening in the housing and an enlarged inner end within the housing;

a leaf spring attached to an inner end of each actuator and adapted to receive a bit;

whereby a bit may be moved from a position of storage within the handle by pressing a pre-selected sactuator, moving the bit attached to the actuator out of the open end of the housing and retracting the actuator, and thus the attached bit, to engage the bit in the recess of the internal column

2. A screwdriver as claimed in claim 1 in which the housing is in two parts.

3. A screwdriver as claimed in claim 2 in which the two parts are joined together by pins in one part engaging recesses in the other part; and means to hold the two parts together.

4. A screwdriver as claimed in claim 1 in which the recess in the column is hexagonal and each bit has a corresponding hexagonal end.

5. A screwdriver as claimed in claim 4 in which each bit is formed with a dimple; and a spring loaded ball attached to the central column to hold the bits in place in the recess.

6. A screwdriver as claimed in claim 1 in which the leaf spring is bifurcated at one end to extend around the bridge of the actuator, the ends of the bifurcations extending downwardly to engage the enlarged inner end.

7. A screwdriver as claimed in claim 6 in which the leaf spring is formed with a housing at its distal end to hold a bit.

8. A screwdriver as claimed in claim 1 in which the leaf spring is formed integral with the external thumb piece.

9. A screwdriver as claimed in claim 8 including a second, integral leaf spring extending from the thumb piece to contact the exterior of the handle.

10. A screwdriver as claimed in claim 1 including raised portions adjacent each opening to engage an actuator to ensure that the actuator can remain in its withdrawn position by frictional engagement of a projection and the actuator.

* * * * *